US006220353B1

(12) United States Patent
Foster et al.

(10) Patent No.: US 6,220,353 B1
(45) Date of Patent: Apr. 24, 2001

(54) FULL BORE SET DOWN TOOL ASSEMBLY FOR GRAVEL PACKING A WELL

(75) Inventors: Michael J. Foster, Houston; Steven L. Anyan, Sugar Land, both of TX (US); Harold Steven Bissonnette, Lafayette, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/302,974

(22) Filed: Apr. 30, 1999

(51) Int. Cl.[7] ..... E21B 43/04

(52) U.S. Cl. ..... 166/278; 166/51; 166/387

(58) Field of Search ..... 166/278, 51, 276, 166/387, 227, 235

(56) References Cited

U.S. PATENT DOCUMENTS

| | | | | |
|---|---|---|---|---|
| 3,329,205 | | 7/1967 | Brown . | |
| 3,913,676 | | 10/1975 | Barbee, Jr. et al. . | |
| 4,042,033 | | 8/1977 | Holland et al. . | |
| 4,253,522 | | 3/1981 | Setterberg, Jr. . | |
| 4,470,465 | | 9/1984 | Zimmerman et al. . | |
| 4,540,051 | | 9/1985 | Schmuck et al. . | |
| 4,566,538 | | 1/1986 | Peterson . | |
| 4,606,408 | | 8/1986 | Zunkel et al. . | |
| 4,627,488 | * | 12/1986 | Szarka | 166/51 |
| 4,633,943 | | 1/1987 | Zunkel . | |
| 4,635,716 | | 1/1987 | Zunkel . | |
| 4,638,859 | | 1/1987 | Zunkel et al. . | |
| 4,862,957 | | 9/1989 | Scranton . | |
| 4,940,093 | | 7/1990 | Hilsman, III . | |
| 5,069,280 | * | 12/1991 | McKee et al. | 166/278 |
| 5,174,379 | | 12/1992 | Whiteley et al. . | |
| 5,332,038 | * | 7/1994 | Tapp et al. | 166/278 |
| 5,366,009 | * | 11/1994 | Cornette et al. | 166/51 |
| 5,597,040 | | 1/1997 | Stout et al. . | |
| 5,641,023 | | 6/1997 | Ross et al. . | |
| 5,845,712 | | 12/1998 | Griffith, Jr. . | |

FOREIGN PATENT DOCUMENTS 0 903 463 A2 3/1999 (EP) .

* cited by examiner

*Primary Examiner*—Roger Schoeppel
(74) *Attorney, Agent, or Firm*—Trop, Pruner & Hu P.C.

(57) ABSTRACT

A full bore set down tool assembly provides a housing attached to a packer in a wellbore and aligned with the production zone. A service tool of the tool assembly is attached to a tubing string extending to the surface and is adapted for selective, removable attachment to and positioning within the housing. The tool assembly defines a downstream flow path and a return flow path when the service tool is attached to the housing. A ball valve that is selectively shiftable from the surface opens and closes the return flow path to define a circulate position and a squeeze position. The housing, service tool, and ball valve also define a reverse position. The tool assembly facilitates gravel packing of the annulus between the wellbore casing and the service string including the tool assembly.

27 Claims, 11 Drawing Sheets

FULL BORE SET DOWN TOOL ASSEMBLY FOR GRAVEL PACKING A WELL

BACKGROUND OF THE INVENTION

1. Field of Invention

The present invention relates to the field of well tools. More specifically, the invention relates to a device and method for gravel packing a well that also allows for perforating or fracturing a well in a single trip and that allows full bore access through the device and with weight set down on the device.

2. Related Art

Techniques are well known in the oil and gas industry for controlling sand migration into wells penetrating unconsolidated formations by gravel packing the wells. Sand migration and collapse of unconsolidated formations can result in decreased flow and production, increased erosion of well components, and production of well sand which is a hazardous waste requiring specialized handling and disposal. Such gravel packing typically consists of depositing a quantity, or "pack," of gravel around the exterior of a perforated liner and screen, with the pack preferably extending into the perforations in the unconsolidated formation. The gravel pack then presents a barrier to the migration of the sand while still allowing fluid to flow from the formation. In placing the gravel pack, the gravel is carried into the well and into the formation in the form of a slurry, with much of the carrier fluid or workover fluid being returned to the surface, leaving the gravel in the desired location.

Attempts have been made in the past to minimize the number of trips of the tool string into the well. Each trip of the tool string into a well takes an appreciable amount of time, and therefore incurs significant costs in terms of rig and crew time. As will be readily apparent, these costs are dramatically increased if the tool string is tripped to a great depth in a well. Further, previous devices allow for the use of perforating guns attached to the bottom of the gravel pack tool assembly so that the perforating and gravel pack may be completed in a single trip. The same is true for fracturing equipment which may be attached to prior tool assembles to facilitate fracturing and gravel packing in a single trip.

One problem associated with prior designs relates to control and positioning of the tool assembles. As fluid from the surface is pumped through the tubing and into the well to complete the gravel pack, the tubing tends to shrink due to the temperature differential between the surface and the bottom of the wellbore where the gravel pack is performed. Additionally, other factors may contribute to or cause tubing shrinkage. The tubing shrinkage may create uncertainty as to the positioning of the tool assembly in relation to the packer, sand screen, and other gravel pack components. Some tool assemblies rely on the position of the tool assembly in relation to the fixed downhole components required for the gravel pack to determine the function of and flow paths through the tool assembly. Thus, uncertainty in the positioning of the tool assembly may cause the tool assembly to inadvertently shift from one operation to another. For example, the distance between a circulate position and a squeeze position in one prior tool is only about 18 inches. Shrinkage may move the tool from squeeze to circulate changing the flow paths and operation of the tool. Similarly, in operations performed from a floating platform, the deck heave can change the position of the tool assembly causing uncertainty in the tool assembly positioning. Accordingly, there is a need for a gravel pack tool assembly that eliminates the uncertainty associated with the positioning of the tool assembly and the operating position of the tool assembly.

Another problem associated with prior tool assembles is that they block or restrict the size of the bore through the tool assembly. The restriction limits the ability to perform operations below the tool assembly. For example, in a tool assembly that includes the perforating equipment attached to the bottom of the tool, the manner of actuating the perforating guns is limited. One preferred manner of actuating the perforating guns is to drop a detonation bar through the tubing into engagement with the perforating guns to fire the guns. Typical tool assembles that restrict or block the tubing do not allow a detonation bar to pass therethrough. Thus, the use of a detonation bar in such an operation is not possible. Consequently, despite the use of the prior art features, there remains a need for a tool assembly that provides for full bore diameter through the tool assembly to allow for operations to be performed through the tool assembly, such as logging operations, and/or to allow the passage of well tools, such as wireline and slickline tools, logging tools, chemical cutters, drop balls, detonation/drop bars, and the like, through the tool assembly.

SUMMARY

To achieve such improvements, the present invention provides a full bore, set down tool assembly that provides a full bore diameter through the tool, in one preferred embodiment, and that is set in a packer in the wellbore in constant compression when in at least the circulate and squeeze positions to ensure the proper positioning and operation of the tool assembly. In general, the tool assembly incorporates a shiftable ball valve to alternate between a circulate and squeeze positions. When in the open position, the ball valve provides for full bore access through the tool assembly and in the closed position substantially prevents flow through the return path of the tool assembly to allow for a squeeze or reverse operation.

One aspect of the present invention provides a tool assembly for use in a tool string for gravel packing an annular area of a wellbore surrounding at least a portion of the tool string in the wellbore. The tool assembly includes a packer and a housing attached to the packer. The housing defines a bore therethrough and at least one orifice provides communication between an exterior of the housing and the bore. A service tool of the tool assembly is selectively attachable to a tubing string and is adapted for selective positioning within the housing. A selectively shiftable ball valve mounted within the service tool is selectively and remotely shiftable between an open position and a closed position. The service tool defines at least two alternate flow paths and the ball valve is adapted and positioned to selectively open and close at least one of the alternate flow paths.

The tool assembly also includes a downstream flow path of the alternate flow paths and a return path of the alternate flow paths with the ball valve positioned in the return flow path. The housing, the service tool, and the ball valve define and are shiftable between at least a squeeze position, a circulating position, and a reverse position.

One aspect of the present invention includes an attachment member adapted for selective releasable attachment of the service tool to the housing. The attachment member includes a collar attached to the housing and a collet attached to the service tool with the collar and the collet adapted for cooperative, releasable mating attachment. The housing, the service tool, and the ball valve define and are shiftable between at least a squeeze position and a circulating position and the attachment member is adapted to attach the service tool to the housing when the housing, the service tool, and the ball valve are in the squeeze position and the circulating position.

In one preferred embodiment, the ball valve defines a valve passageway therethrough when the ball valve is in the open position. The service tool defines a service tool bore therethrough that comprises at least a portion of one of the at least two alternate flow paths. The diameter of the valve passageway is substantially equal to the diameter of the service tool bore. Further, the service tool bore and the valve passageway are sized and adapted to permit passage of a well tool therethrough.

Another aspect of the present invention provides a tool assembly for use in a tool string for gravel packing an annular area of a wellbore surrounding at least a portion of the tool string in the wellbore. The tool assembly includes a housing assembly that defines a first flow path and a second flow path. A ball valve of the housing assembly is adapted to selectively open and close one of the first and second flow paths and the first and second flow paths are adapted to provide fluid communication of a gravel pack material and a return fluid. The ball valve defines a valve passageway therethrough when the ball valve is in an open position. Preferably, the diameter of the valve passageway is about equal to the diameter of the associated one of the first and second flow paths within which the ball valve is positioned.

Yet another aspect of the present invention provides a gravel pack assembly for use in a tool string for gravel packing an annular area of a wellbore surrounding at least a portion of the tool string in the wellbore. The gravel pack assembly includes a packer and a housing having a first end and a second end. The housing defines a bore therethrough and at least one orifice that provides fluid communication between an exterior of the housing and the bore. The housing is attached to the packer proximal the first end of the housing. Typically, a sand screen is attached to the housing proximal the second end of the housing. The screen is adapted to allow the flow of fluids therethrough. A service tool is selectively attachable to and positionable within the housing and defines a downstream flow path and a return flow path. The downstream flow path communicates with the bore of the housing when the service tool is positioned therein. The return path communicates with the sand screen. The service tool has a valve in the return flow path that is adapted to selectively open and close the return flow path to control the flow of fluid therethrough. The diameter of the opening through the valve when the valve is open is substantially equal to the diameter of the bore so that the valve is adapted to provide access therethrough without substantially reducing the cross sectional area and diameter of the bore. Further, the service tool, the housing, and the ball valve define at least a squeeze position and a circulating position when the service tool is attached to the housing. The service tool and the housing are adapted to support compressive loading when attached. When the service tool is detached from the housing, the service tool, the housing, and the ball valve define at least a reverse position.

Still yet another aspect of the present invention provides a tool assembly for performing a gravel pack. The tool assembly includes a service tool adapted for selective attachment to a service string. The service tool defines a downstream flow path and a return path therethrough. Also included is a valve within the return path selectively moveable between an open position and a closed position and adapted to control the flow through the return path. The valve is adapted to provide a full bore opening therethrough when in the open position.

Another selected embodiment comprises a housing attached to the packer that defines a bore therethrough. A service tool is adapted for selective, removable mating with the housing. An attachment member is adapted for selective, releasable attachment of the service tool and the housing. The service tool is selectively shiftable between at least a circulating position and a squeeze position; and the attachment member is engaged to attach the service tool to the housing when the service tool is in the circulating position and the squeeze position.

Another aspect of the present invention provides a method of gravel packing a well using a tool assembly that defines at least a downstream flow path and a return flow path and has a ball valve in the return path. The method includes positioning the tool assembly in the well and selectively shifting the tool assembly between at least a circulate position and a squeeze position to perform the gravel pack and actuating the ball valve to a open position in the circulating position and a closed position in the squeeze position.

Yet another aspect of the present invention provides a tool assembly for performing a gravel pack that includes a tool assembly body with means for directing fluid through the tool assembly body to perform the gravel pack; means for selectively blocking a return flow through the body to define at least a squeeze position and a circulating position; and means for supporting a load on the tool assembly body when the tool assembly body is in at least the squeeze position and the circulating position.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a full bore, set down tool assembly that provides a full bore diameter through the tool, in one preferred embodiment, and that is set in a packer in the wellbore in constant compression when in at least the circulate and squeeze positions to ensure the proper positioning and operation of the tool assembly. In general, the tool assembly incorporates a shiftable ball valve to alternate between a circulate and squeeze positions. When in the open position, the ball valve provides for full bore access through the tool assembly and in the closed position substantially prevents flow through the return path of the tool assembly to allow for a squeeze or reverse operation.

Figure 1:
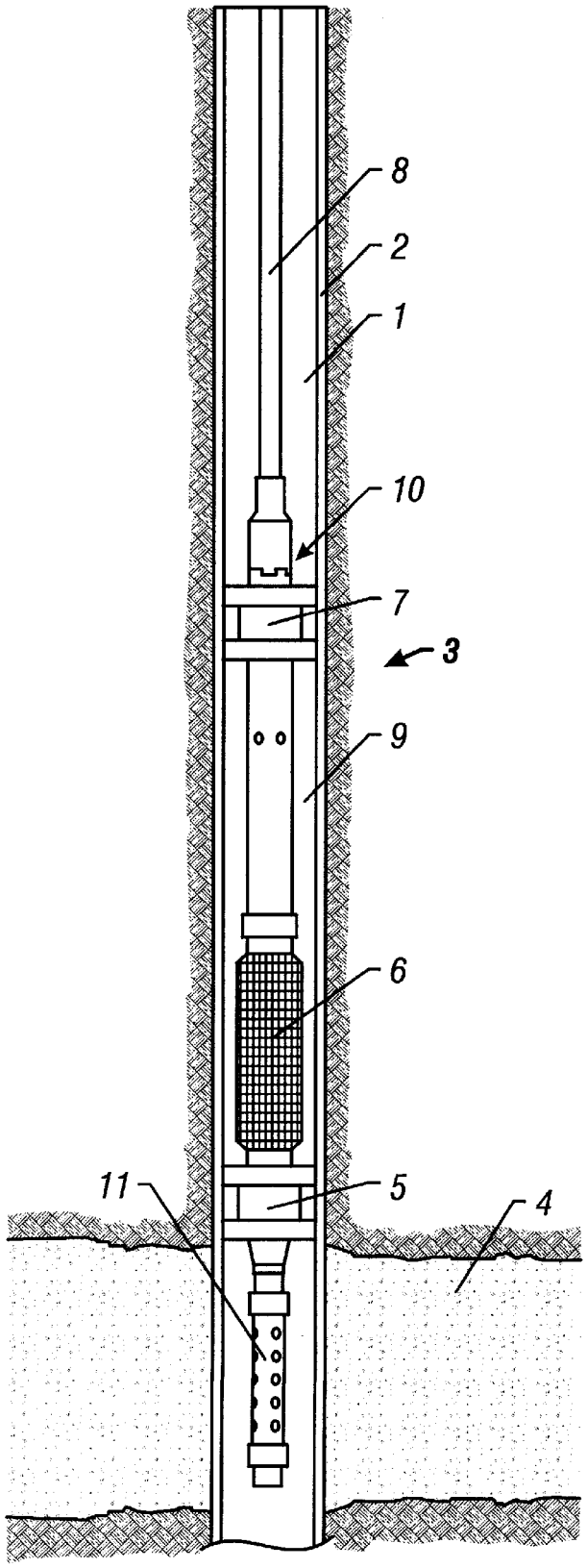
FIG. 1 is schematic view of a service string including the present invention positioned in a well.
Figure 2A:
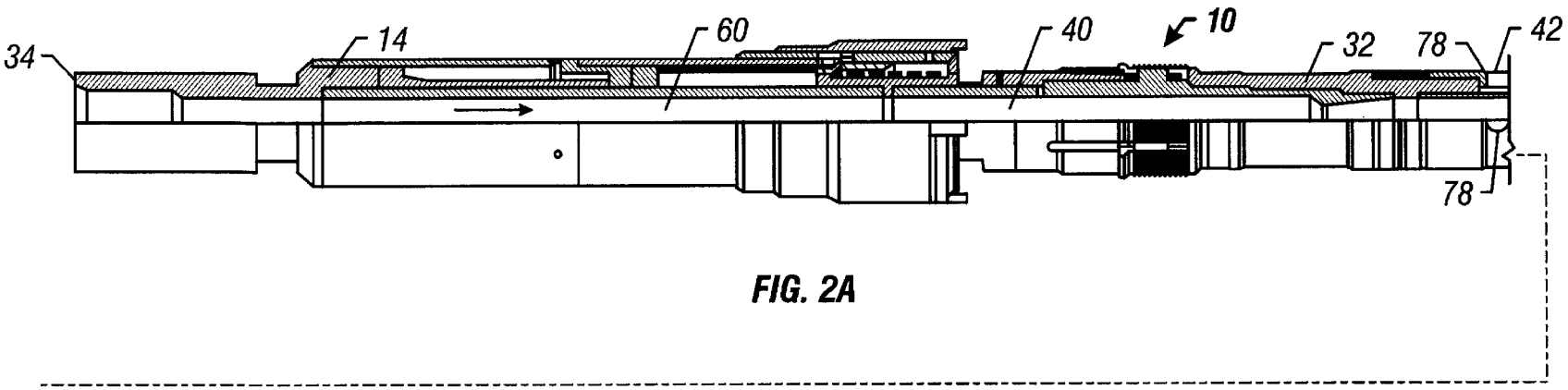
FIGS. 2A–D are a partial cross sectional, side elevational of the present invention in the squeeze position.
Figure 2B:
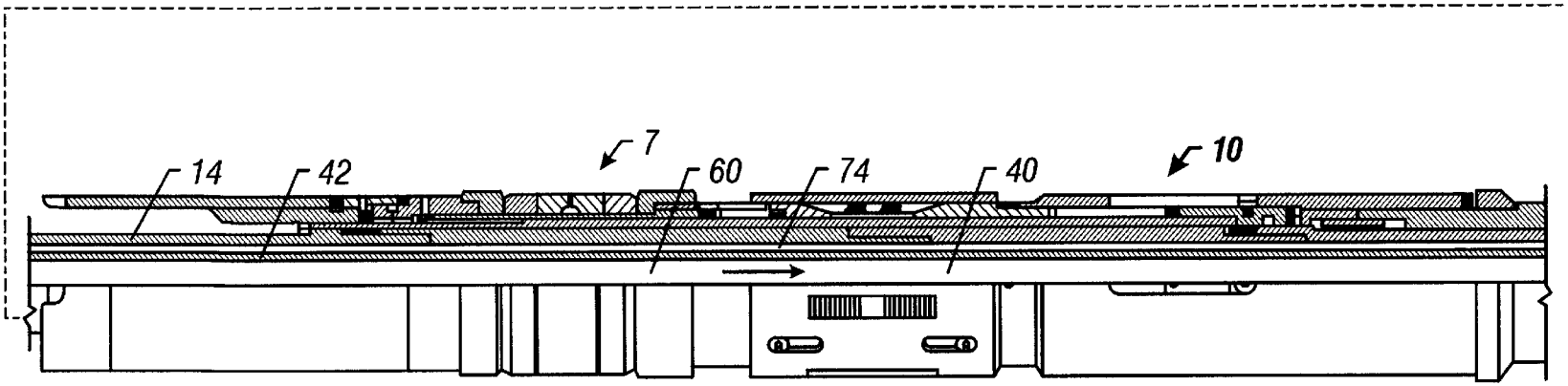
Figure 2C:
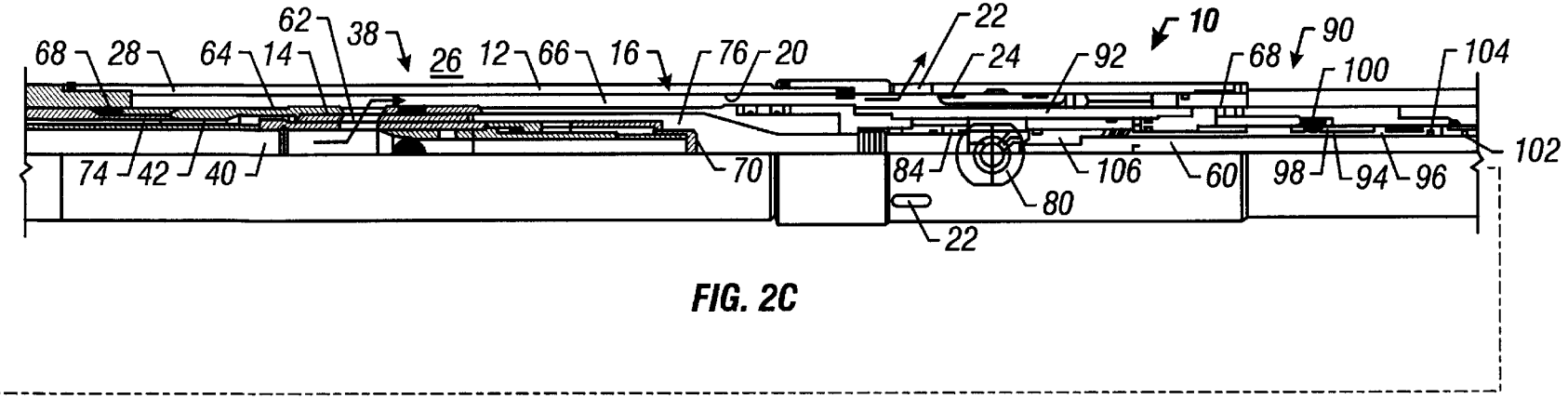
Figure 2D:
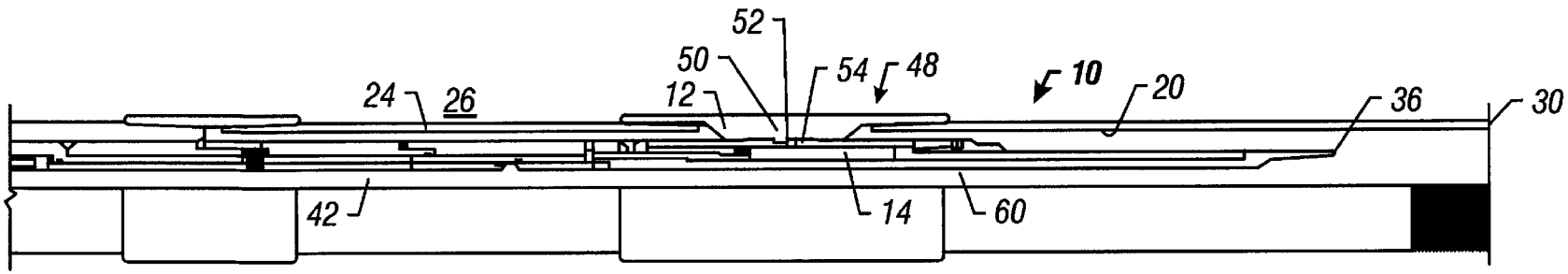

FIG. 1 is a schematic view of a wellbore 1 having a service string 3 therein. The service string 3 includes a perforating gun aligned with the zone to be produced, a bottom packer 5, a sand screen 6, a gravel pack tool assembly 10, and a tool assembly packer 7. The service string 3 is supported by a tubing string 8 extending to the surface. In this embodiment, the perforating guns fire to perforate the production zone. Then, the service string 3 is lowered to align the packers above and below the perforations and the packers are set isolating the production zone and defining an annulus area between the service string 3 and the casing 2. The gravel pack is then performed and the zone produced. The present invention is useful in such an operation as well as other operations requiring a gravel pack, and is useful in operations other than those requiring perforation and gravel packing in a single trip.

A typical gravel pack operation includes three operations (among others) referred to as the squeeze operation, the circulating operation, and the reverse operation. In the squeeze operation, the gravel slurry is forced out into the formation 4 by pumping the slurry into the production zone while blocking a return flow path 42. The absence of a return flow path 42 causes the pressure to build and force the slurry into the formation 4. When the void spaces within the formation 4 are "filled," the pressure will rise quickly, referred to as "tip screen out." Upon tip screen out, the next typical step is to perform a circulating operation in which the gravel slurry is pumped into the annular area 9 between the sand screen 6 and the casing 2. In the circulating position, the return flow path 42 is open and the return fluid is allowed to flow back to the surface. The sand screen 6 holds the gravel material of the gravel slurry in the annular area 9 but allows fluids to pass therethrough. Thus, circulating the gravel slurry to the sand screen 6 deposits the gravel material in the annular area 9. However, during the circulating operation, when the deposited gravel material reaches the top of the sand screen 6, the pressure will rise rapidly indicating screen out and a full annulus. Note that an alternative manner of operating the tool is to perform the squeeze operation with the tool assembly 10 in the circulate position and with a surface valve (not shown) closed to prevent return flow. Using this method, the shift from the squeeze operation to the circulate operation may be made by simply opening the surface valve and without the need to shift the tool.

When the annulus is packed, the string may be pulled from the wellbore 1. However, to prevent dropping of any gravel material remaining in the service string 3 and the tubing 8 into the well when pulling the string from the well, the gravel in the tubing 8 and service string 3 is reverse circulated to the surface before the string is removed. This procedure of reverse circulating the remaining gravel from the well is referred to as the reverse operation. In general, the flow of fluid is reverse circulated through the tubing 8 to pump the gravel remaining in the tubing string 8 and service string 3 to the surface.

Generally, because bridging may occur when depositing the gravel in the well creating gaps in the gravel pack, the squeeze and/or circulating operations may be performed more than once for each gravel pack operation. This is referred to as "restressing the pack." The reverse operation may be performed before restressing the packing or between the squeeze and circulate operations as desired.

A tool assembly 10 facilitates the gravel pack operation. As used herein, the terms squeeze position, circulating position, and reverse position shall refer to a position of the tool assembly 10 corresponding to the squeeze operation, the circulating operation, and the reverse operation respectively.

Also, for the purposes of this discussion, the terms "upper" and "lower," "up hole" and "downhole," "up," "down," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore 1 is highly deviated, such as from about 60 degrees from vertical, or horizontal, these terms do not make sense and therefore should not be taken as limitations. These terms are only used for ease of understanding as an indication of what the position or movement would be if taken within a vertical wellbore 1.

FIGS. 2A–D are a cross sectional elevational view of one preferred embodiment of the tool assembly 10 (also referred to as the gravel pack assembly). The tool assembly 10 generally comprises a housing 12 attached to a packer 7 and a service tool 14 adapted for removable attachment to the housing 12. By shifting the service tool 14 and controlling the relative positioning of the service tool 14 to the housing 12, the tool assembly 10 is shiftable between the squeeze, circulating, and reverse positions. When viewed in combination, the housing 12 and service tool 14 are also referred to herein as the housing assembly 16.

The housing 12 has an elongated tubular body defining a bore 20 therethrough. At least one orifice defined by the housing 12 extends through a side wall 24 of the housing 12 to provide fluid communication between the bore 20 and an exterior 26 of the housing 12. A first end 28 of the housing 12, typically, the upper end, is attached to, or proximal to, a packer 7. When set, the packer 7 maintains the position of the packer 7 and the housing 12 relative to the production zone and prevents their movement within the wellbore 1. Note that the packer 7 may define a portion of the housing 12. Attached to a second, or bottom, end 30 of the housing 12 is the sand screen 6.

The service tool 14 has a generally cylindrical body sized and adapted to fit within and mate with the bore 20 of the housing 12. The service tool 14 is adapted for selective, releasable attachment to and positioning of at least a portion thereof within the housing 12. A first, or upper, end 34 of the service tool 14 is adapted for attachment to the tubing string 8 such as by threaded connection, with the service tool bore 60 in fluid communication with the tubing string 8. To facilitate the gravel pack operation, the service tool 14 defines at least two alternate flow paths 38, comprising at least first and second flow paths, 40 and 42 respectively. In general, one flow path, the downstream flow path 40, delivers the gravel pack material in the circulating and squeeze operations; and the other, second flow path provides the return path 42.

The alternate flow paths 38 are adapted to provide a live annulus wherein the well annulus above the service tool packer 7 communicates with the formation while the service tool 14 is in use. Thus, if pumping is halted, the operator can still monitor the pressure below the packer 7. Prior systems do not provide a live annulus.

The service tool 14 is releasably attachable to the housing 12 by an attachment member 48. In general, the attachment member 48 is adapted to temporarily attach the service tool 14 to the housing 12 and to support a load necessary to keep a compressive load on the service tool 14. In the preferred embodiment shown in FIG. 1, the service tool 14 is attached to the housing 12 with the attachment member 48 engaged during the circulate and squeeze operations. The service tool 14 is detached and the attachment member 48 disengaged during the reverse operation. Attaching the service tool 14 to the housing 12 during the squeeze and circulate operations ensures that the tool assembly 10 is in the proper position during the relevant operations and provides added reliability. The relatively high load capacity of the attachment member 48 allows the tool assembly 10 to operate with weight set down on the tool assembly 10, further adding to the reliability of the tool.

In one embodiment, the attachment member 48 comprises a collar 50 attached to the housing 12 defining a profile 52 therein. A collet 54 attached to the second, bottom end 36 of the service tool 14 is adapted for releasable, cooperative mating with the profile 52 of the collar 50. The spring force, or snap force, of the collet 54 provides a resistance to upward movement and detachment of the collet 54 from the collar 50 offering a resistance to detachment and providing the operator with assurance of proper relative positioning of the service tool 14 and the housing 12. During shifting of the service tool 14, the collet 54 is pulled from the collar 50 and then, typically, forced back into the collar 50. The resistance offered by the snap force of the collet 54 provides a positive indication at the surface to the operator that the tool 14 has shifted. Other similar attachments of the service tool 14 to the housing 12 are readily apparent to those skilled in the art and are, therefore, considered a part of the scope of the present invention. Further, the attachment member 48, in one alternative embodiment (not shown), is replaced with a shoulder adapted to support the load requirements. In this alternative embodiment, the service tool 14 is not "attached" to the housing 12, but is maintained in the housing 12 by substantially maintaining a downward force on the service tool 14.

The service tool 14 defines a service tool bore 60 extending longitudinally therethrough. Service tool orifices 62 (at least one) extend through the wall of the service tool 14 and provide fluid communication between the service tool bore 60 and an exterior 64 of the service tool 14. The service tool orifices 62 are positioned in the service tool 14 such that, when the service tool 14 is positioned in and attached to the housing 12, so that the tool assembly 10 is in the circulating or squeeze position, the service tool orifice 62 communicates with an housing assembly annulus 66 formed between the service tool 14 and the housing 12. The housing orifices 22 are also positioned to communicate with the housing assembly annulus 66. Seals 68 mounted above and below the service tool orifice 62 and the housing orifices 22 seal the top and bottom of the housing assembly annulus 66 between the service tool 14 and the housing 12. Accordingly, the service tool orifices 62, the housing assembly annulus 66, and the housing orifices 22 provide a fluid communication passageway from the service tool bore 60 to the annular area 9 between the tool assembly 10 and the casing 2 of the wellbore 1 when the tool assembly 10 is in the circulating or squeeze positions. Thus, the service tool bore 60 and the service tool orifice 62 define a downstream flow path 40 through the service tool 14; the service tool bore 60, the service tool orifice 62, the housing assembly annulus 66 and the housing orifice 22 define a downstream flow path 40 through the housing assembly 16 that provides communication between the tubing string 8 and the annulus formed between the service string 3 and the wellbore 1 when the tool assembly 10 is in the circulating or squeeze positions.

A plug 70 in the service tool 14 positioned below the service tool orifices 62 prevents flow through the service tool bore 60 beyond the plug 70. In alternative embodiments, the plug 70 is either fixed and integral with the body of the service tool 14 or is a removable plug 70 (FIGS. 5A–D) that is adapted for selective insertion and placement within the service tool bore 60. For example, in those embodiments that require a full open bore through the tool assembly 10 to provide a passageway for a well tool, such as a detonation/drop bar, a ball, a logging tool, a wireline or slickline tool, a chemical cutter, and the like, through the tool assembly 10, the insertable type plug 70 is required. Using the insertable type plug 70, the well tool is passed through the tool assembly 10 prior to inserting the plug 70. The tool assembly 10 is then operated with the plug 70 in place.

The service tool 14 firther defines at least one, but preferably a plurality of, return passageways 74 extending longitudinally through the wall of the service tool 14. The inlets 76 to the return passageways 74 are positioned on a side of the plug 70 opposite to the position of the service tool orifices 62 so that the plug 70 prevents fluid communication between the service tool orifices 62 and the return passageway 74 inlets 76 via the service tool bore 60. Further, the return passageways 74 are offset from the service tool orifices 62 in the wall of the service tool 14 to prevent communication therebetween. The outlets of the return passageways 74 are positioned proximal the first, upper end of the service tool 14 and communicate with an exterior 64 of the service tool 14. Therefore, the return passageways 74 provide fluid communication between the service tool bore 60 below the plug 70 to the exterior 64 of the service tool 14 at a position proximal the first, upper end of the service tool 14. The outlets 78 of the return passageways 74 are positioned in the service tool 14 such that when the tool assembly 10 is in the circulating or squeeze position the outlets 78 are above the packer 7 providing communication between the annulus formed between the tubing string 8 and the casing 2 and the service tool bore 60 below the plug 70. The service tool bore 60 below the plug 70 and the return passageways 74 are collectively referred to herein as the return path 42.

Figure 3:
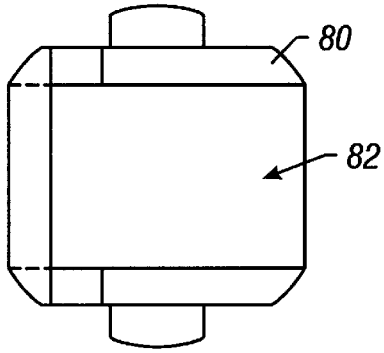
FIG. 3 is a top view of the ball valve.

A ball valve 80 (FIG. 3 is a top view of the ball valve 80) of the service tool 14 is provided in the return path 42, specifically in the service tool bore 60 below the plug 70 in one preferred embodiment. The ball valve 80 is adapted to move between an opened position and a closed position. In the closed position, the ball valve 80 substantially seals the service tool bore 60 preventing flow through the return path 42. In the open position, the ball valve 80 permits fluid flow therethrough and through the return path 42. Further, in the preferred embodiment, the ball valve 80 defines a valve passageway 82, when in the open position, that has a diameter that is substantially about equal to the diameter of the service tool bore 60 to provide full bore access through the service tool 14. Thus, the service tool bore 60 and the valve passageway 82 are sized and adapted to permit a well tool to pass therethrough providing a full bore passageway through the tool assembly 10. The ball valve 80, in one preferred embodiment, includes an energized seal 84 (a spring loaded seal) to ensure sealing between the ball and the service tool bore 60. Note that, although the preferred embodiment is described as a ball valve 80, the present invention may incorporate any type of valve 80 that is capable of providing a valve passageway 82 capable of providing a full open bore therethrough that does not substantially reduce the cross sectional area of the bore through the service tool 14 to allow passage of well tools through the tool assembly 10.

A shifting mechanism 90 of the service tool 14 actuates the ball valve 80 between the open and closed positions. An upper portion 92 of the service tool 14 is free to move axially relative to a lower portion 94 of the service tool 14 within a predefined limited range. The relative axial movement is achieved when the lower portion 94 is attached to the housing 12 by way of the attachment mechanism. The upper portion 92 is then moved axially by an operator controlling the position of the tubing string 8 from the surface. Thus, the operator moves the tubing string 8 and, thus, the upper portion 92 of the service tool 14 providing relative movement between the upper and lower portions, 92 and 94, actuating the shifting mechanism 90. Note that the snap force of the collet 54 provides a positive indication that the tool 14 has shifted.

Figure 4:
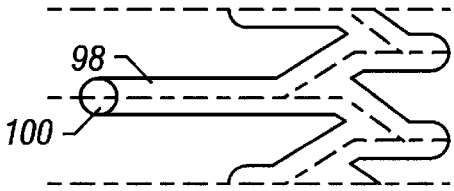
FIG. 4 is a schematic view of the j-slots in the squeeze position.
Figure 6:
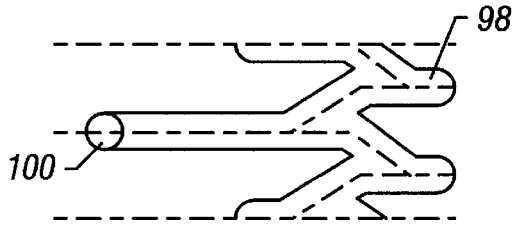
FIG. 6 is a schematic view of the j-slots in the squeeze position.
Figure 8:
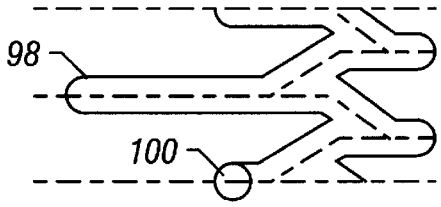
FIG. 8 is a schematic view of the j-slots in the circulate position.
Figure 10:
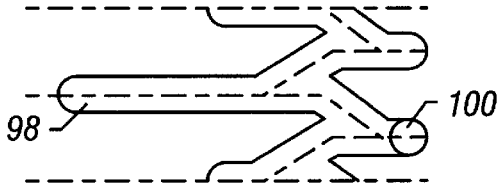
FIG. 10 is a schematic view of the j-slots in the return position.
Figure 5A:
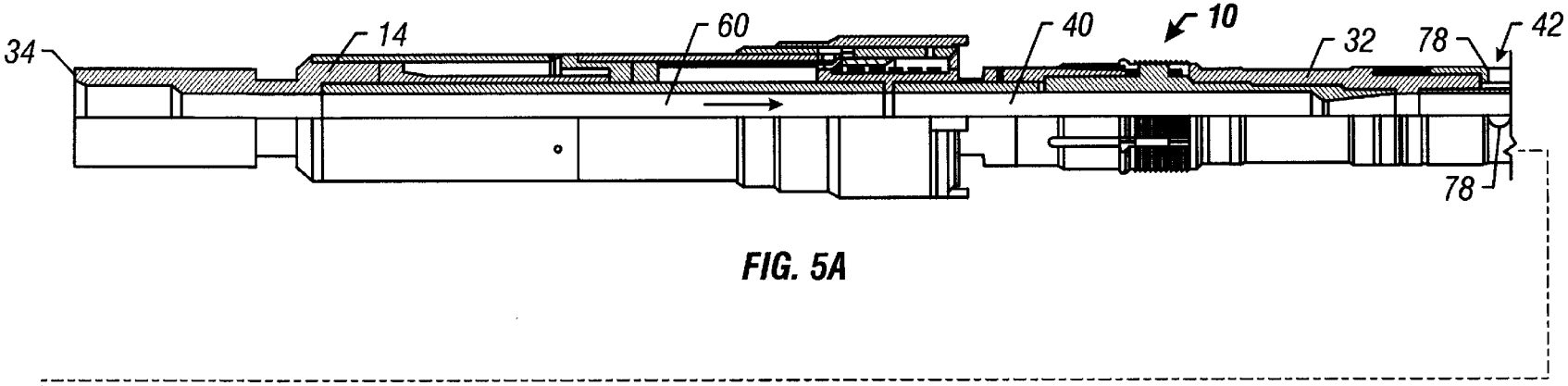
FIGS. 5A–D are a partial cross sectional, side elevational of an alternative embodiment of the present invention in the squeeze position.
Figure 5B:
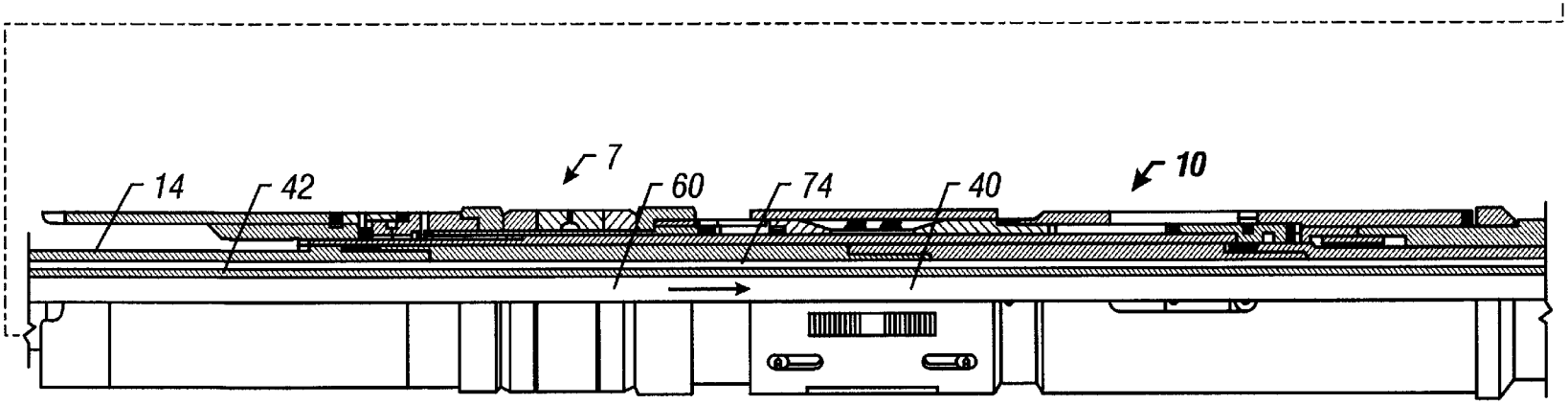
Figure 5C:
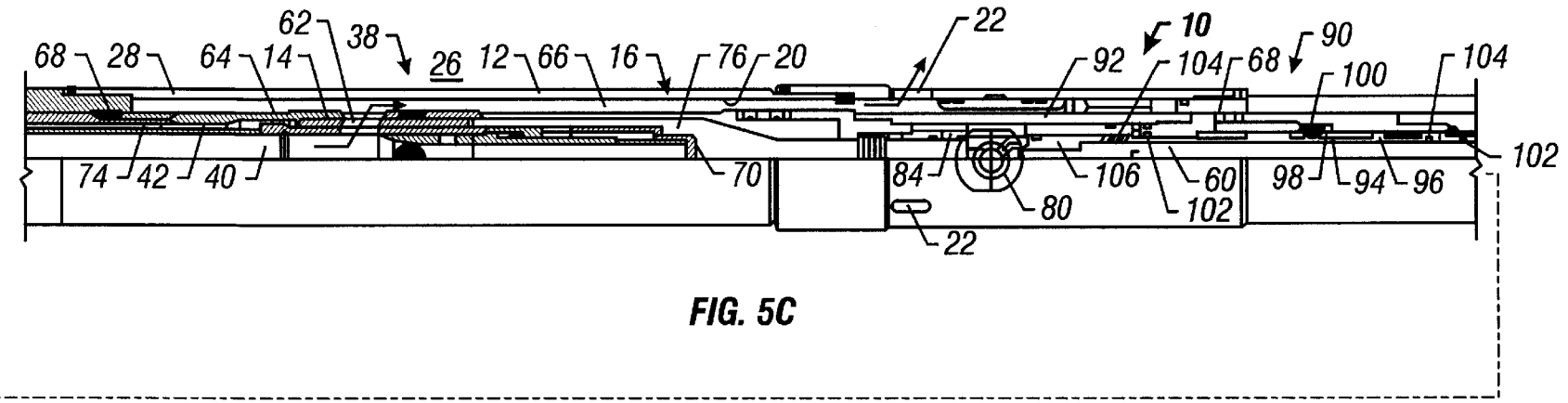
Figure 5D:
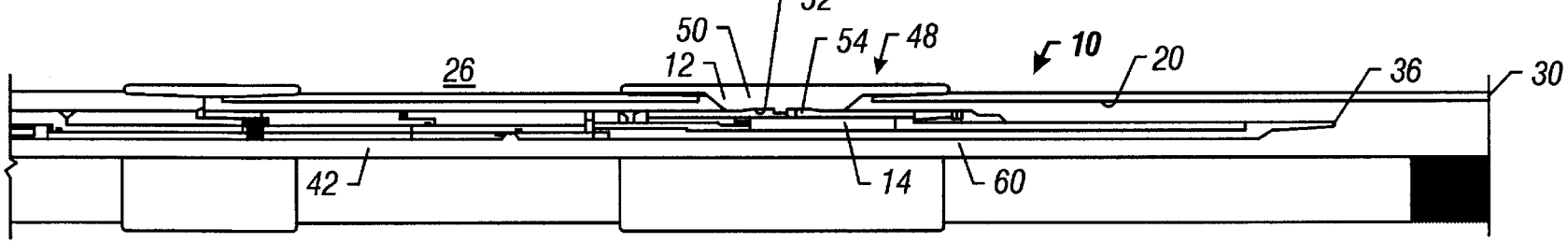

The shifting mechanism 90 comprises a mandrel 96 positioned in the service tool 14 such that it is free to spin relative to the remainder of the service tool 14. The mandrel 96 has a series ofjslots 98 (well know in the art) adapted to mate with a pin 100 fixed to lower portion 94 of the service tool 14. The j-slots 98 and pin 100 cooperate to produce a predetermined rotation (such as 45°) of the mandrel 96 for each up or down cycle of the upper portion 92 relative to the lower portion 94. FIGS. 4, 8, and 10 show the j-slots 98 and pin 100 positioned for the squeeze, circulate, and reverse positions respectively. The shape, positioning, and length of the j-slots 98 in cooperation with an interconnected control lug member 102 and mating control lug receiver 104 are adapted to selectively limit the allowable axial movement of the upper portion 92 relative to the lower portion 94. A yolk 106 attached to the mandrel 96 at one end is attached to the ball valve 80 at the opposite end and is adapted to move axially within the service tool 14. The movement of the mandrel 96 and the control lug member 102 control the position of the yolk 106 to selectively open and close the ball valve 80 in response to relative movement of the upper portion 92 of the service tool 14 to the lower portion 94. In one preferred embodiment, the valve 80 is closed upon pickup and open upon every other set down of the service tool 14.

In operation, the tool assembly 10 is typically run into the wellbore 1 with the service tool 14 attached to the housing 12 and the downstream flow path 40 providing a reference pressure with the annulus and the tubing string 8. The tool assembly 10 may be run into the wellbore 1 with the ball valve 80 in either the open or closed position. Once in the proper position, the packers are set and the housing 12 position is established.

As discussed, in general the first operation is the squeeze operation (FIGS. 2A–D, 4, and 5A–D). In the squeeze operation, the service tool 14 is attached to the housing 12 and the ball valve 80 is closed preventing flow through the return path 42. The gravel slurry is pumped down through the tubing string 8 into the service tool bore 60, through the downstream flow path 40, and into the annulus between the service string 3 and the casing 2. The return path 42 is blocked, therefore, the pressure builds forcing the gravel slurry into the formation 4 until pressure rises rapidly indicating "tip screen out."

Figure 7A:
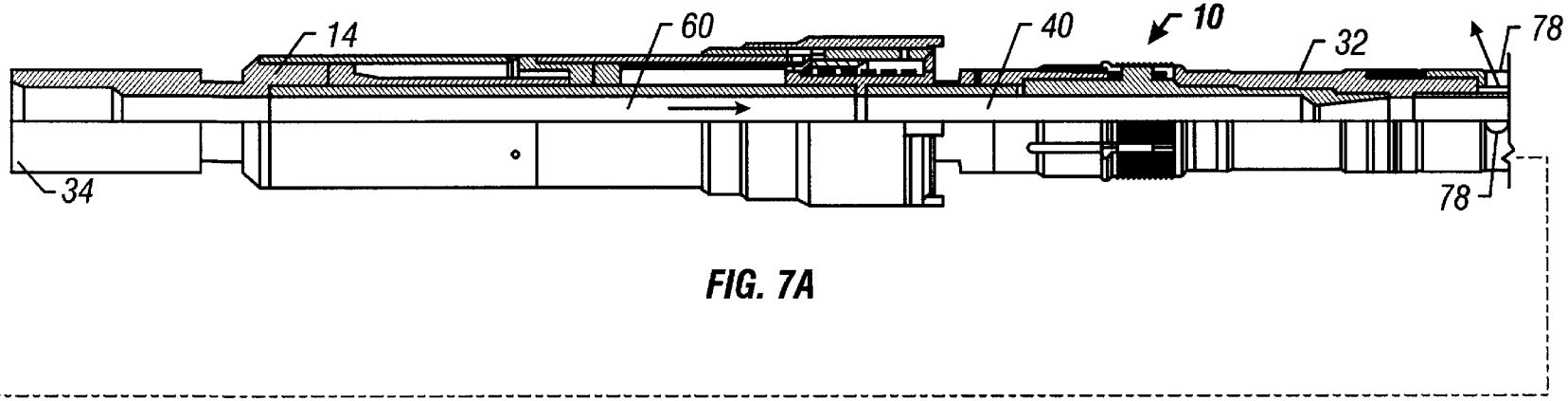
FIGS. 7A–D are a partial cross sectional, side elevational of the present invention in the circulate position.
Figure 7B:
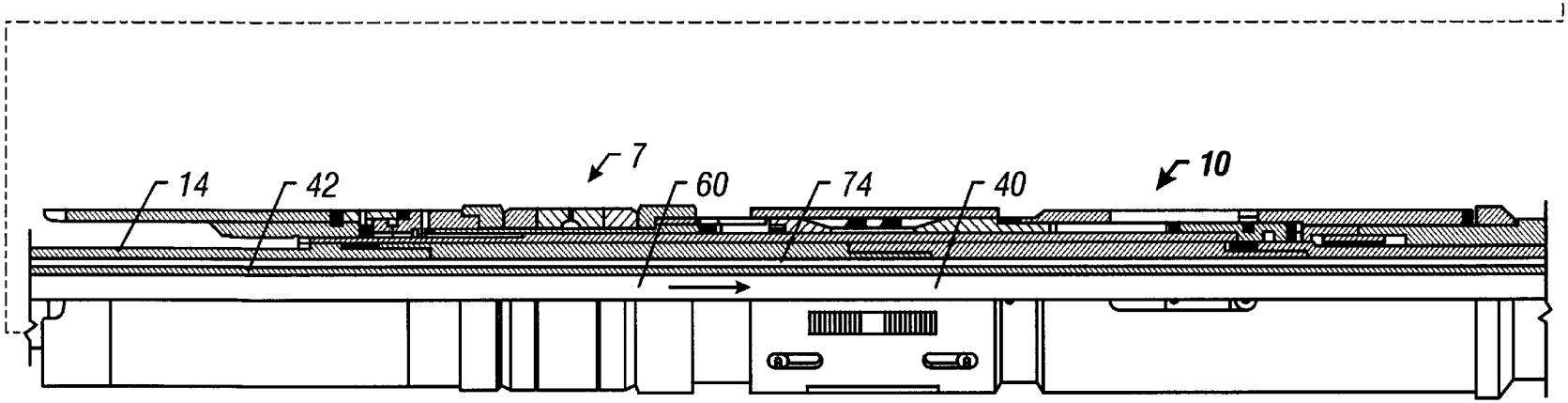
Figure 7C:
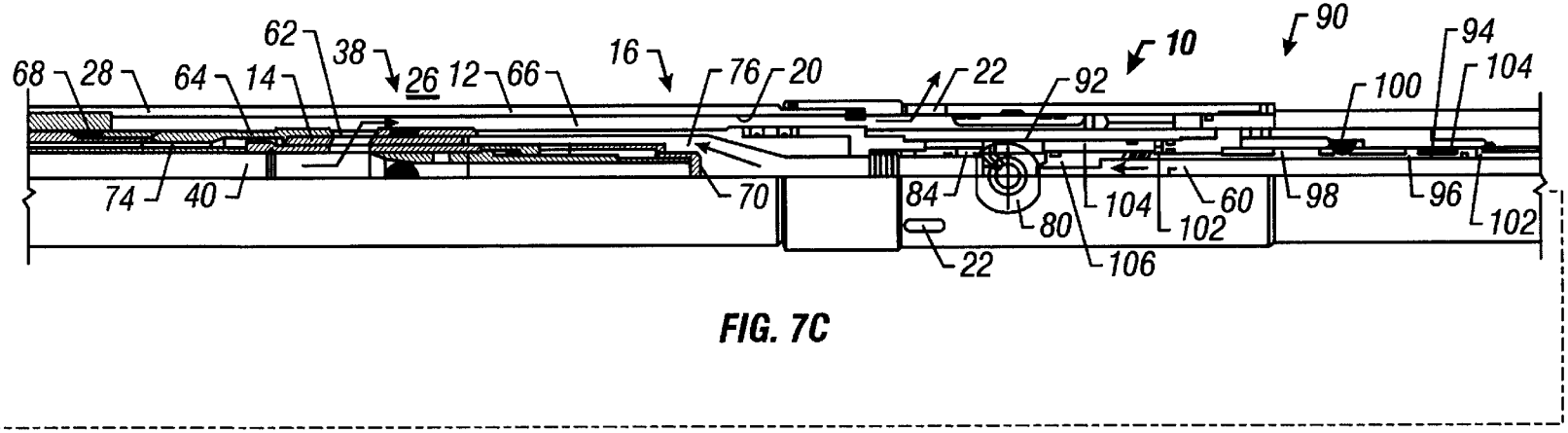
Figure 7D:
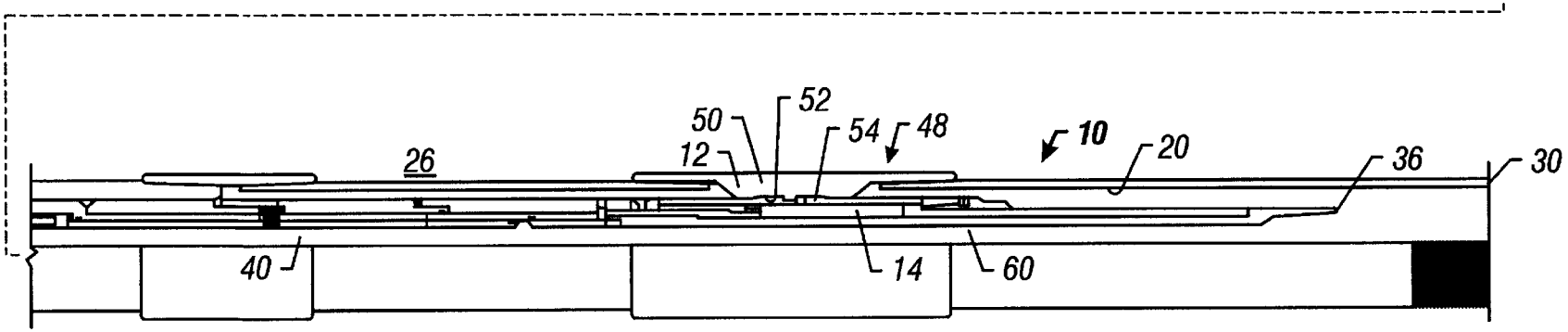
Figure 9A:
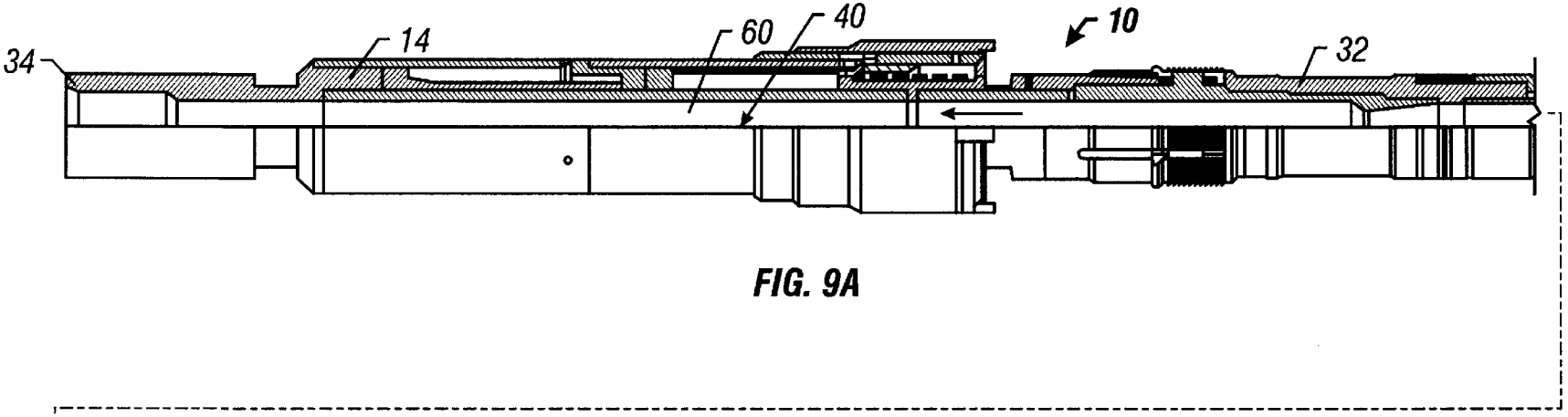
FIGS. 9A–E are a partial cross sectional, side elevational of the present invention in the return position.
Figure 9B:
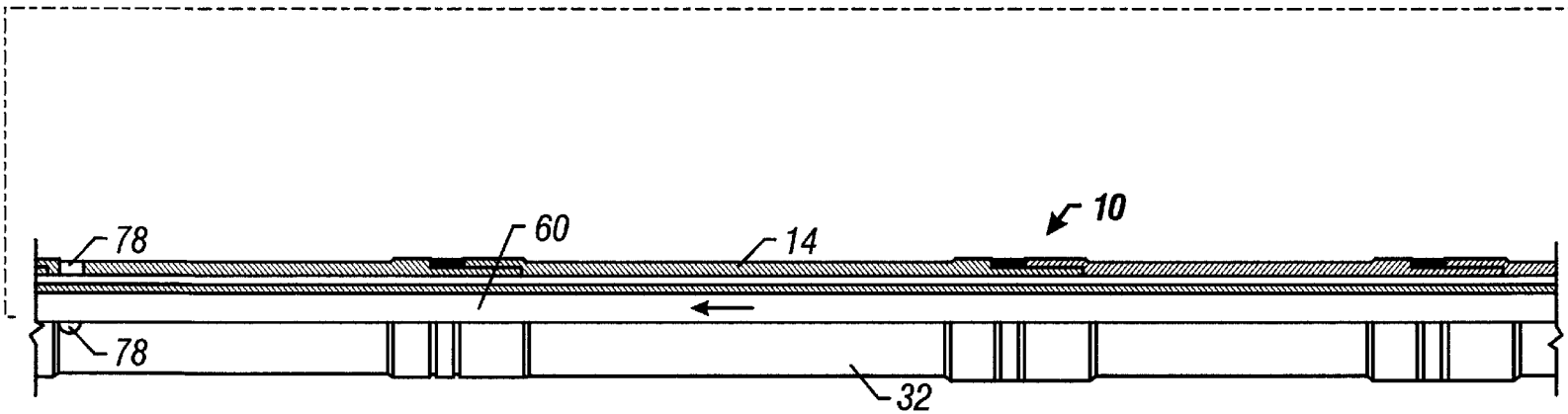
Figure 9C:
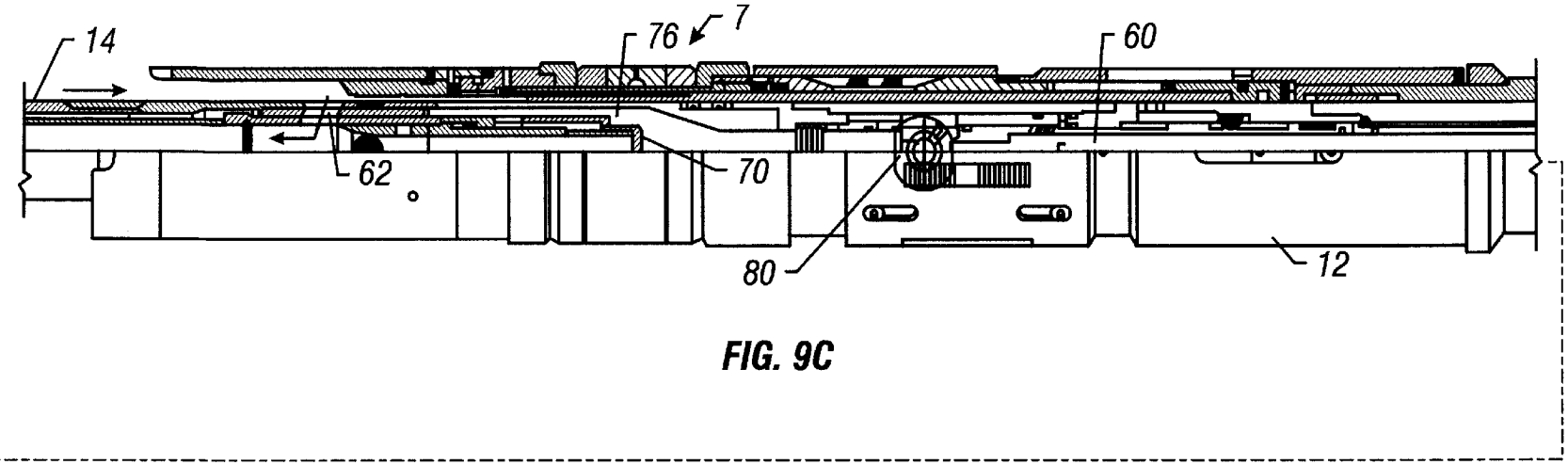
Figure 9D:
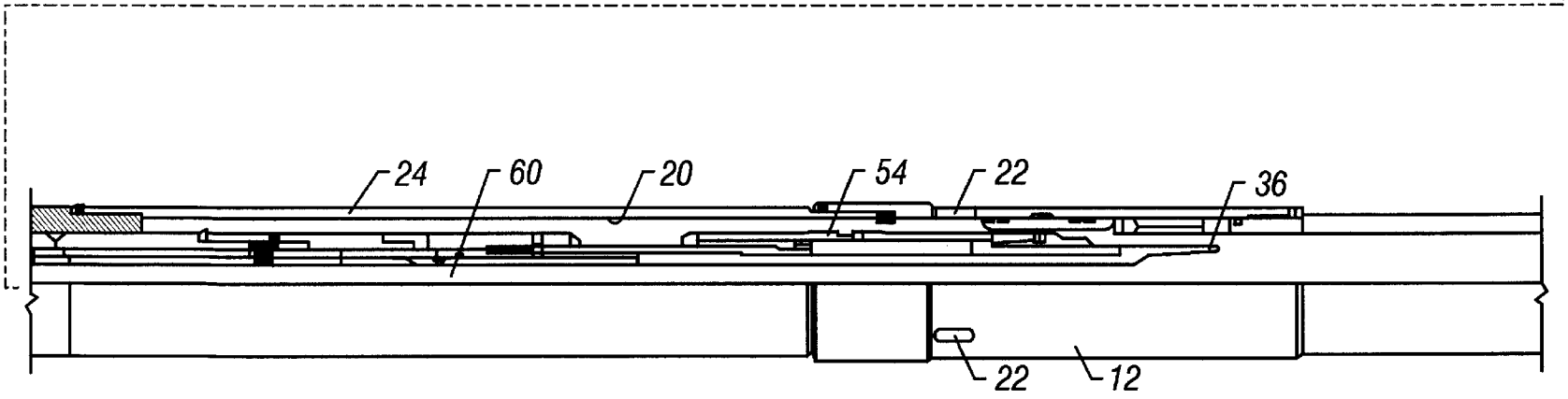
Figure 9E:
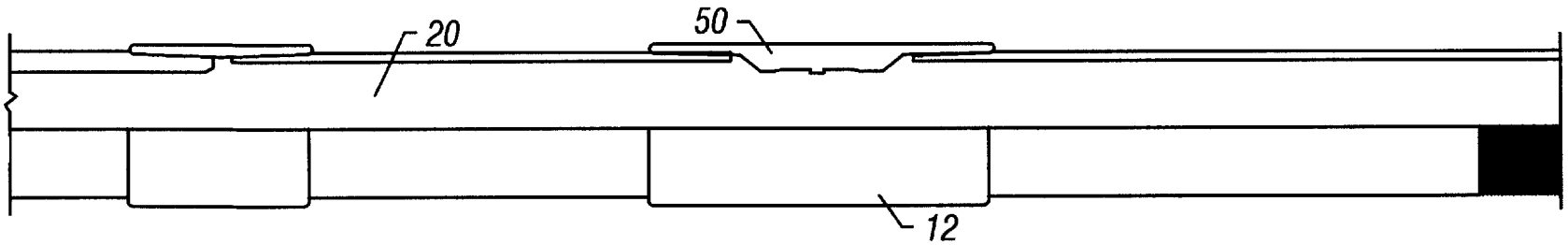

Once tip screen out occurs, the tool assembly 10 is shifted to the circulating position (FIGS. 7A–D and 8) by lifting and lowering the tubing to move the upper portion 92 of the service tool 14 the required number of times, as defined by the shifting mechanism 90 (see FIG. 8 for the j-slot position), to shift the service tool 14 and move the ball valve 80 to the open position (FIG. 7C). During the shifting of the service tool 14, collet 54 of the attachment member 48 is pulled from the collar 50 providing a surface indication that the tool has shifted. Thus the snap force of the collet 54 is selected to provide the desired surface indication. The collet 54 is forced back into the collar 50 to further shift the tool assembly 10. This shifting process is repeated as necessary When in the open position the return path 42 is open. The gravel slurry is pumped through the tubing string 8 to the service tool bore 60, through the downstream flow path 40, and into the annulus between the service string 3 and the wellbore casing 2 below the tool assembly packer 7 where the gravel material is deposited. The return fluid flows through the sand screen 6, into the service tool bore 60 through the second, lower end below the plug 70, through the return path 42 of the service tool 14, and into the annulus between the tubing string 8 and the casing 2 at a point above the packer 7. The return fluid then flows to the surface. Upon screen out, the circulating operation is stopped. The squeeze and circulating operations may be repeated as needed by simply shifting the service tool 14 as described to selectively open and close the ball valve 80.

After the circulating and squeeze operations are complete, the reverse operation is typically performed in preparation of pulling the service string 3 from the wellbore 1. To position the service tool 14 in the reverse position (FIGS. 9A–E and 10), the tool assembly 10 is shifted by lifting the tubing to move the upper portion 92 of the service tool 14, as defined by the shifting mechanism 90 (see FIG. 10 for the j-slot position), to shift the service tool 14 and move the ball valve 80 to the closed position (in the preferred embodiment shown, the ball is closed upon pick-up of the service tool 14). The attachment member 48 is then detached releasing the service tool 14 from the housing 12 typically by pulling up on the tubing string 8 with sufficient force to release the actuating mechanism. Then, the service tool 14 is lifted from the housing 12 to a position at which at least the service tool orifices 62 are positioned above the packer 7. The well is reverse circulated pumping "clean" fluid down through the annulus, through the service tool orifices 62 into the service tool bore 60, up through the service tool bore 60 into the tubing string 8, and through the tubing string 8 to the surface. Any gravel slurry remaining in the tubing string 8 and the service tool bore 60 is forced to the surface with the exception possibly of a small amount deposited between the service tool orifices 62 and the ball valve 80.

While the foregoing is directed to the preferred embodiment of the present invention, other and further embodiments of the invention may be devised without departing from the basic scope thereof, and the scope thereof is determined by the claims which follow. It is the express intention of the applicant not to invoke 35 U.S.C. § 112, paragraph 6 for any limitations of any of the claims herein, except for those in which the claim expressly uses the words "means for" together.

What is claimed is:

1. A tool assembly for use in a tool string for gravel packing an annular area of a wellbore surrounding at least a portion of the tool string in the wellbore, the tool assembly comprising:

a packer;

a housing attached to the packer, the housing defining a bore therethrough and further defining at least one orifice providing communication between an exterior of the housing and the bore;

a service tool selectively attachable to a tubing string and adapted for selective positioning within the housing;

a selectively shiftable ball valve mounted within the service tool, the ball valve selectively, remotely shiftable between an open position and a closed position;

the service tool defining at least two alternate flow paths; and the ball valve adapted and positioned to selectively open and close at least one of the at least two alternate flow paths.

2. The tool assembly of claim 1, further comprising:

a downstream flow path of the at least two alternate flow paths;

a return path of the at least two alternate flow paths; and the ball valve positioned in the return flow path.

3. The tool assembly of claim 1, further comprising:

the housing, the service tool, and the ball valve defining and shiftable between at least a squeeze position and a circulating position.

4. The tool assembly of claim 3, further comprising:

the housing, the service tool, and the ball valve also defining and shiftable between a reverse position.

5. The tool assembly of claim 1, further comprising:

an attachment member adapted for selective releasable attachment of the service tool to the housing.

6. The tool assembly of claim 5, wherein the attachment member further comprises:

a collar attached to the housing;

a collet attached to the service tool;

the collar and the collet adapted for cooperative, releasable mating attachment.

7. The tool assembly of claim 5, further comprising:

the housing, the service tool, and the ball valve defining and shiftable between at least a squeeze position and a circulating position;

the attachment member adapted to attach the service tool to the housing when the housing, the service tool, and the ball valve are in the squeeze position and the circulating position.

8. The tool assembly of claim 1, further comprising:

the ball valve defining a valve passageway therethrough when the ball valve is in the open position;

the service tool defining a service tool bore therethrough, the service tool bore comprising at least a portion of one of the at least two alternate flow paths; and the diameter of the valve passageway substantially equal to the diameter of the service tool bore.

9. The tool assembly of claim 8, further comprising:

the service tool bore and the valve passageway sized and adapted to permit passage of a well tool therethrough.

10. A tool assembly for use in a tool string for gravel packing an annular area of a wellbore surrounding at least a portion of the tool string in the wellbore, the tool assembly comprising:

a housing assembly defining a first flow path and a second flow path;

a ball valve of the housing assembly adapted to selectively open and close one of the first and second flow paths; and the first and second flow paths adapted to provide fluid communication of a gravel pack material and a return fluid, the ball valve adapted to be actuated to a first position to block flow of the return fluid to enable a squeeze operation and to be actuated to a second position to allow flow of the return fluid to enable a circulate operation.

11. The tool assembly of claim 10, further comprising:

the ball valve defining a valve passageway therethrough when the ball valve is in an open position;

the diameter of the valve passageway is about equal to the diameter of the associated one of the first and second flow paths within which the ball valve is positioned.

12. A gravel pack assembly for use in a tool string for gravel packing an annular area of a wellbore surrounding at least a portion of the tool string in the wellbore, the assembly comprising:

a packer;

a housing having a first end and a second end, the housing defining a bore therethrough and at least one orifice providing fluid communication between an exterior of the housing and the bore;

the housing attached to the packer proximal the first end of the housing a sand screen adapted to allow the flow of fluids therethrough in fluid communication with the housing, the sand screen positioned below the second end of the housing;

a service tool selectively attachable to and positionable within the housing, the service tool defining a downstream flow path and a return flow path;

the downstream flow path communicating with the bore of the housing when the service tool is positioned therein;

the return path communicating with the sand screen;

the service tool having a valve in the return flow path, the valve adapted to selectively open and close the return flow path to control the flow of fluid therethrough; and the valve adapted to control the flow through the return flow path.

13. The gravel pack assembly of claim 12, further comprising:

the diameter of the opening through the valve when the valve is open is substantially equal to the diameter of the bore so that the valve is adapted to provide access therethrough without substantially reducing the cross sectional area and diameter of the bore.

14. The gravel pack assembly of claim 12, further comprising:

the service tool, the housing, and a ball valve defining at least a squeeze position and a circulating position when the service tool is attached to the housing.

15. The gravel pack assembly of claim 14, further comprising:

the service tool and the housing adapted to support compressive loading when attached.

16. The gravel pack assembly of claim 12, further comprising:

the service tool, the housing, and a ball valve defining at least a reverse position when the service tool is detached from the housing.

17. A tool assembly for performing a gravel pack, the tool assembly comprising:

a service tool adapted for selective attachment to a service string;

the service tool defining a downstream flow path and a return path therethrough;

a valve within the return path selectively moveable between an open position and a closed position and adapted to control the flow through the return path, the valve in the open position to enable a circulate operation and in the closed position to enable a squeeze operation; and the valve adapted to provide a full bore opening therethrough when in the open position.

18. The tool assembly of claim 17, wherein the valve comprises a ball valve.

19. A gravel pack assembly, comprising:

a housing attached to a packer, the housing defining a bore therethrough;

a service tool adapted for selective, removable mating with the housing;

an attachment member adapted for selective, releasable attachment of the service tool and the housing;

the service tool selectively shiftable between at least a circulating position and a squeeze position;

the attachment member engaged to attach the service tool to the housing when the service tool is in the circulating position and the squeeze position.

20. The gravel pack assembly of claim 19 wherein the service tool is further selectively shiftable to a reverse position, the attachment member disengaged to detach the service tool from the housing when the service tool is in the reverse position.

21. The gravel pack assembly of claim 20 further comprising a packer, wherein the service tool has at least one orifice, the at least one orifice being positioned below the packer when the service tool is in the circulating position and the squeeze position and being positioned above the packer when the service tool is in the reverse position.

22. The gravel pack assembly of claim 19, further comprising a valve, the valve being at a first position when the service tool is in the circulating position and at a second position when the service tool is in the squeeze position.

23. The gravel pack assembly of claim 22, further comprising a valve actuating mechanism operably coupled to the valve, the valve actuating mechanism adapted to be operated by shifting of the service tool.

24. A method of gravel packing a well using a tool assembly defining at least a downstream flow path and a return flow path and having a ball valve in the return path, the method comprising:

positioning the tool assembly in the well;

selectively shifting the tool assembly between at least a circulating position and a squeeze position to perform the gravel pack, and actuating the ball valve to an open position in the circulating position and a closed position in the squeeze position.

25. The method of claim 24, further comprising selectively shifting the tool assembly to a reverse position to perform a reverse operation.

26. The method of claim 25 further comprising actuating the ball valve to the closed position when the tool assembly is in the reverse position.

27. A tool assembly for performing a gravel pack, the tool assembly comprising:

a tool assembly body;

means for directing fluid through the tool assembly body to perform the gravel pack;

means for selectively blocking a return flow through the body to define at least a squeeze position and a circulating position, the means for blocking comprising a ball valve;

means for supporting a load on the tool assembly body when the tool assembly is in at least the squeeze position and the circulating position.

* * * * *